US005217639A

United States Patent [19]

Mottola

[11] Patent Number: 5,217,639

[45] Date of Patent: Jun. 8, 1993

[54] DUAL PHASE TOILET BAR CONTAINING A CLEAR PORTION AND AN OPAQUE PORTION JOINED ALONG A SINGLE CURVELINEAR SHAPED SURFACE

[75] Inventor: Nicholas Mottola, New York, N.Y.

[73] Assignee: Elizabeth Arden Company, Division of Conopco, Inc., New York, N.Y.

[21] Appl. No.: 803,001

[22] Filed: Dec. 5, 1991

[51] Int. Cl.[5] ..... C11D 17/00

[52] U.S. Cl. ..... 252/90; 252/134; 252/174; 252/DIG. 16; 252/368; D28/8.1

[58] Field of Search ..... 252/90, 134, 174, DIG. 16, 252/368, 92; D28/8.1, 8.2

[56] References Cited

U.S. PATENT DOCUMENTS

| | | | |
|---|---|---|---|
| 2,820,768 | 1/1958 | Fromont | 252/118 |
| 3,557,006 | 1/1971 | Ferrara et al. | 252/134 |
| 3,793,214 | 2/1974 | O'Neill et al. | 252/117 |
| 3,926,828 | 12/1975 | O'Neill et al. | 252/117 |
| 3,969,259 | 7/1976 | Lages | 252/106 |
| 3,993,722 | 11/1976 | Borcher et al. | 252/134 |
| 4,094,807 | 6/1978 | Humphreys et al. | 252/90 |
| 4,206,069 | 6/1980 | Borrello | 252/117 |
| 4,405,492 | 9/1983 | Nyquist et al. | 252/134 |
| 4,468,338 | 8/1984 | Lindberg | 252/105 |
| 4,493,786 | 1/1985 | Joshi | 252/134 |
| 4,504,433 | 3/1985 | Inui et al. | 252/90 |
| 4,517,107 | 5/1985 | Clarke et al. | 252/108 |
| 4,741,854 | 5/1988 | Krupa et al. | 252/105 |
| 4,988,453 | 1/1991 | Chambers et al. | 252/122 |
| 4,996,000 | 2/1991 | Redeker | 252/90 |
| 5,002,685 | 3/1991 | Chambers et al. | 252/134 |
| 5,041,234 | 8/1991 | Instone et al. | 252/118 |

FOREIGN PATENT DOCUMENTS

| | | | |
|---|---|---|---|
| 977194 | 10/1948 | France | 252/134 |
| 61-155499 | 7/1986 | Japan . | |
| 1-247499 | 10/1989 | Japan | 252/90 |
| 2-294400 | 12/1990 | Japan | 252/90 |

*Primary Examiner*—Paul Lieberman
*Assistant Examiner*—Bradley A. Swope
*Attorney, Agent, or Firm*—Milton L. Honig

[57] ABSTRACT

A dual-phase toilet bar is provided having a first portion that is at least translucent and a second portion that is opaque. Each portion of the bar has at least 80% by weight of its components identical. The opaque portion incorporates a solid particulate opacifying agent. A process is also disclosed wherein a clear composition is poured into a mold to partly fill same. Thereafter, an opaque composition is poured into the remaining volume of the mold, this composition being essentially identical to the clear composition but also including a small amount of solid particulate opacifying agent. Alternatively the opaque composition may be poured first into the mold followed by the clear composition.

9 Claims, 1 Drawing Sheet

DUAL PHASE TOILET BAR CONTAINING A CLEAR PORTION AND AN OPAQUE PORTION JOINED ALONG A SINGLE CURVELINEAR SHAPED SURFACE

BACKGROUND OF THE INVENTION

1. Field of the Invention

The invention concerns a two-phase soap bar defined by a clear and opaque area and a process for production thereof.

2. The Related Art

Soap bars which are clear have a certain aesthetic appeal to consumers. Often consumers associate clarity with "naturalness" which is a sought after benefit. Consequently, there is a demand for clear soap bars.

Bars of varying clarity, form and other physical properties have been described in the literature. Methods of manufacture are numerous and varied.

One of the earliest patents in the area is that of U.S. Pat. No. 2,820,768 (Fromont) which describes a transparent, substantially non-alkaline soap formed from a mixture of alkali metal soap and the reaction product between a free fatty acid and triethanolamine. The components are mixed together under heating at 100°-120° C. to obtain a homogeneous clear mass which is maintained upon cooling. This mass is poured into frames, cooled, cut and pressed into cakes or bars. Fromont is the basis for the bar product known as "Neutrogena".

U.S. Pat. No. 5,041,234 (Instone et al.) describes bars of high soap content that include a solvent system of water, triethanolamine and polyols. U.S. Pat. No. 3,793,214 and U.S. Pat. No. 3,926,828, both to O'Neill, describe utilizing mixtures of alkaline sodium compounds and alkanolamines to neutralize free fatty acids to obtain a glossy surface appearance even after repeated use of the product.

Japanese Patent 61/155499 (Hara) formulates amino acids in place of alkanolamines to achieve similar fast drying times but with the added benefits of avoiding stickiness resulting from hygroscopicity and of good lathering. U.S. Pat. No. 4,206,069 (Borrello) overcomes the surface stickiness problem through careful selection of soap, detergent and solvent concentrations. U.S. Pat. No. 4,988,453 and U.S. Pat. No. 5,002,685, each assigned to Chambers et al., disclose translucent detergent bars based on a composition of soap, mono- and dihydric alcohols and water. Sugars (i.e. sucrose, fructose or glucose), cyclic polyols (i.e. glycerol, sorbitol or mannitol) and polyalkylene glycols were found useful as further components.

Several patents advocate special additives. U.S. Pat. No. 4,493,786 (Joshi) details use of lanolin and lanolin derivatives for inhibiting crystallization of soap thereby promoting clarity. U.S. Pat. No. 4,468,338 (Lindberg) fortifies a bar with sulfites to prevent progressive darkening upon storage. U.S. Pat. No. 4,741,854 (Krupa et al.) inhibits discoloration through a combination of sulfite and hydride compounds. U.S. Pat. No. 3,969,259 (Lages) discovered germicide could be incorporated into a milled transparent soap without any opacifying effect. The germicide must, however, be first dissolved in a perfume material. The perfume solution is then added to the composition at any point between drying of the soap chips and extrusion thereof through a plodder.

In a more unusual approach, U.S. Pat. No. 4,517,107 obtains a translucent product through use of a cavity transfer mixer that shears the soap.

Finally, there is U.S. Pat. No. 4,504,433 (Inui et al.) describing a soap article containing dried shapes also formed of soap. The process reported therein includes the steps of placing on a bottom of a cylindrical frame a supporting base of transparent soap which has been cooled to solidification but has not yet been dried. The base has a height lower than that of the frame. Thereafter a dried shape of colored soap is placed onto the supporting base. A dough of transparent soap which may or may not be colored is then poured into the frame followed by heating the resultant composition to a molten state. Upon cooling, the solidified transparent soap that results is removed from the frame and further dried.

Beyond the purely transparent bar technology, there have been toilet bars, especially perfume soaps, sold in the Orient, which were a combination of clear and opaque portions. These bars are formed by gluing one surface of a typical extruded opaque soap onto a congruent surface of a cast clear bar. Opaque and clear portions are of different formulations with mostly different ingredients and where the ingredients are identical, the concentrations are often different. The opaque portion is usually produced through the very rapid process of plodding through an extruder while the clear portion requires the much slower casting method of production. A problem with this technology is that wear (i.e. use rate) may be different between different portions of the bar. Additionally, there is limited latitude for providing curvilinear shapes with the known technology.

Even with the aforementioned difficulties, there is great appeal to a two-phase soap. Active ingredients that may be harmed by ultraviolet light can be formulated in the opaque phase. Other ingredients which may be stimulated through light may preferentially be incorporated into the clear phase. Of course, aesthetics can be much more pleasing in a dual phase system. In view of these considerations, it is evident that the art awaits a major advance in this area of technology.

Accordingly, it is an object of the present invention to provide a dual-phase toilet bar of particularly pleasing aesthetics.

Another object of the present invention is to provide a dual-phase toilet bar that functions similar to a plodded conventional opaque soap in its cleansing activity yet has an area which, through mildness, can provide skin benefits associated with clear-type bars.

A further object of the present invention is to provide a dual-phase toilet bar wherein certain active ingredients are incorporated into one phase but not the other.

A still further object of the present invention is to provide a process for manufacturing a dual-phase toilet bar wherein a curvilinear shape is obtainable.

These and other objects of the present invention will become more apparent from the summary, detailed description and example which follow.

SUMMARY OF THE INVENTION

A dual-phase toilet bar is provided comprising:

(i) a first portion that is at least translucent; and (ii) a second portion that is opaque, the second portion achieving opacity through incorporation of from about 0.01 to about 10% of a particulate opacifying agent, the first and second portions having at least 80% by weight of their ingredients being identical.

A method is provided for preparing a toilet bar formed at least 30% thereof with a clear portion and at least 30% thereof with an opaque portion, the method comprising the steps of:

(i) preparing a clear soap composition;

(ii) pouring the clear soap composition into a mold to fill the mold to a level no higher than 90% of its capacity thereby forming the clear portion;

(iii) pouring a second soap composition into the mold onto the clear portion, the second soap composition being opaque having at least 80% by weight of its ingredients identical to that of the clear soap composition, and additionally including from about 0.5–10% by weight of a solid opacifying agent thereby forming the opaque portion; and (iv) cooling and hardening the clear and opaque portions to obtain the toilet bar.

In an alternative aspect of the method, the opaque portion may first be added to the mold followed by pouring of the clear portion, all other steps and conditions being identical as described above.

BRIEF DESCRIPTION OF THE DRAWING

The aforementioned objects, advantages and features of the present invention will become more apparent from the following detailed description and accompanying drawing which is a sole FIGURE illustrating a curvilinear soap bar having a clear and opaque area.

DETAILED DESCRIPTION

Figure 1:
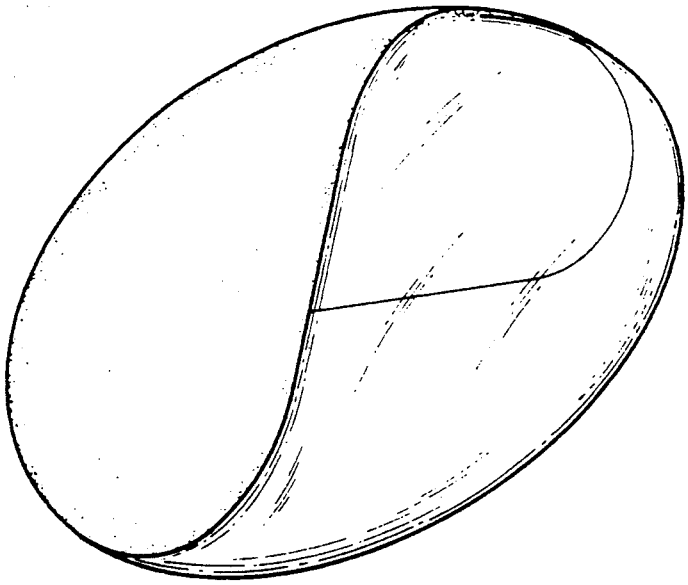

In accordance with the present invention there is provided a toilet bar having a first area that is at least translucent, if not transparent, and a second opaque area. About 80%, preferably at least 90% but optimally greater than 99% of the components by weight of the first and second areas are identical. However, in the second or opaque area, there is additionally provided a certain amount of a solid particulate opacifying agent.

Consequently, an important component of the present invention is a solid particulate opacifying agent present in an amount from about 0.1 to about 5%, preferably from about 0.2 to about 0.8%, optimally between about 0.25 and 0.5% by weight. The opacifying agent may be titanium dioxide, in coated or uncoated form, alumina, zinc oxide, calcium carbonate and other inorganic minerals providing a white background as well as combinations thereof. Particle sizes should range from about 5 to about 150, preferably from about 25 to about 100 microns in diameter.

Compositions of the present invention may, for both areas or portions of the bar, also comprise a soap mixture, a $C_1$–$C_{12}$ alkyl chain monohydric alcohol, a polyol, water and a variety of minor functional ingredients.

Suitable sources of soap are those conventionally employed in soap manufacture and include tallow, coconut oil, castor oil, rosin and other vegetable, animal and marine oils and blends of purified fatty acids. The maximum carbon chain length preferred is C22 and the minimum carbon chain length preferred is C6. Castor oil soap and rosin can be included if very transparent soap is required. Amounts of the soap may range anywhere from about 20 to about 80%, preferably from about 30 to about 60% by weight of the total bar.

Preferably the soap mixture is selected so as to contain, with respect to the total soap content, at least 25 wt. % saturated fatty acid soaps having a carbon chain length of at least 14. A preferred upper limit for such a soap fraction is of the order of 70 wt. %, with respect to the total soap content, although it may depend on what other soap fractions are present. In general terms, however, the amount of saturated longer chain ($C>14$) fatty acid soap is selected having regard to the degree of firmness desired in use in the end bar product, it being these longer chain soaps to which firmness is generally attributed. Preferably also the soap mixture is selected to contain, with respect to the total soap content, at least 30 wt. % of saturated fatty acid soaps having a carbon chain length of less than 14 or unsaturated fatty acid soaps or a mixture thereof. A preferred upper limit for such a fraction is about 75 wt. % with respect to the total soap content although it may depend on other components present in the soap mixture. In general terms, however, this latter soluble soap fraction is believed to be responsible for the quality and quantity of lather achieved in use of the resulting soap bar and can, thus, be selected primarily having regard to the lather properties desired in the end product.

The soap mixture can comprise all sodium soap. Preferably, however, about 10 to about 40 wt. %, more preferably about 20 to about 30 wt. %, of the soap mixture is a soap other than sodium. Preferred soaps other than sodium are potassium and trialkanolamine, especially triethanolamine. The presence of these non-sodium soaps can increase the transparency of the finished product, particularly at overall high soap levels within the present range. Bars having a high level of soap may be preferable because of their increased firmness and other improved in-use properties. Where triethanolamine soaps are included, they are preferably provided by admixing a stoichiometric amount of triethanolamine with fatty acids, such as a 50:50 blend of palmitic and stearic acids.

Bars of this invention may include some non-soap surfactant. Such surfactants can deliver additional benefits in the finished bar, notably improved transparency, relative to the same formulation in the absence of a non-soap surfactant. Thus, it is possible to include cationic, anionic, nonionic or amphoteric non-soap surfactants, in amounts up to 30% by weight, more preferably up to 10% by weight, based on the total bar composition.

Examples of non-soap surfactants that may be included without reducing the bar's transparency and acceptable user properties include sodium alkyl ether sulphates, alkyl benzene sulphonates, dialkyl sulphosuccinates, sodium alkyl betaines and alkyl and dialkyl ethanolamides. Sodium rosinate, although a soap, can be included in this group.

In this invention the bars may contain a monohydric alcohol in an amount of about 1 to about 30%, preferably about 1 to about 3% by weight of the bar. Preferably the monohydric alcohol will contain up to 3 carbon atoms per molecule. Examples are industrial methylated spirits, ethanol and isopropanol. Industrial methylated spirits and ethanol are preferred.

Advantageously, the bars may also contain a polyol component which is a member selected from the group consisting of polyhydric alcohols, sugars, polyalkylene glycols and mixtures thereof. Examples of such ingredients include one or a mixture of:

(i) sugars such as sucrose, fructose and glucose, (ii) linear or cyclic polyols wherein the molecule contains 3 or more carbon atoms and 3 or more alcohol groups such as glycerol, sorbitol or mannitol, (iii) a di or polyalkylene glycol such as diethylene glycol, triethylene glycol or polyethylene glycol having a molecular weight in the range from 400 to 6000.

The polyol component, which should be water-soluble/miscible, can be present in an amount from about 1 to about 30%, preferably from about 5 to about 25% by weight.

Water, when employed in the bars of this invention, should preferably be distilled or deionized. The amount of water is determined, in general, by the levels of other materials present. Suitably, however, the amount of water will range between about 1 and 40% by weight.

A variety of skin treatment active materials may be included at levels ranging anywhere from 0.005 to 1% by weight. These include sodium PCA, sodium hyaluronate, vitamins A, B, E and F, pentavitin and combinations thereof. Additionally, there will be present such minor functional ingredients as preservatives, perfumes, colorants, electrolytes and similar conventional additives. Ultraviolet light sensitive ingredients are formulated into the opaque area for protection against photochemical degradation.

The term "transparent" as sued in this specification is intended to connote its usual dictionary definition. Thus, a transparent soap, like glass, allows ready viewing of objects behind it. A translucent soap will allow light to pass through, although the light will be scattered such that it will be difficult to clearly identify objects behind the translucent soap.

Within the context of this invention, a toilet soap bar is deemed to be transparent is the maximum transmittance of light of any wavelength in the range of 20 to 800 nm through a sample 10 cm thick is at least 3%. A bar is deemed translucent if the maximum transmittance of such light through the sample is between 0.01% and less than 3%. Finally, a bar is deemed opaque if the maximum transmittance of such light is below 0.01%. This transmittance can be easily measured by placing a solid soap sample of the required thickness in the light beam path of a UV-VIS Spectrophotometer such as the Hewlett-Packard 8451A Diode Array Spectrophotometer. The advantage of this method of assessing transparency is that it is highly sensitive to optical clarity while independent of color.

Alternatively, a test for "transparency" can be to place the soap bar over a printed matter having a bold-faced type of 14 point size. If, through a ¼" section of the soap, the print can easily be read, then the bar is considered to be transparent.

Another important aspect of the present invention is the process by which the toilet bar is prepared, In a first step, the ingredients are heated at 50° to 100° C., preferably 70° to 80° C., under agitation for a period of about 1 to 24 hours, preferably 2 to 5 hours, in a saponification reactor. Thereafter, a portion of the resulting clear soap base is cast into a cooling mold to a level that will leave room for an additional amount of charge. Upon cooling and maturation to a level just short of hardening (from 0.5 to 2 hours), an identical soap base, except containing a small amount of opacifying agent, is poured into the mold on top of the clear soap base. Subsequent to cooling, the mold is opened, polished, naturally allowed to dry (about 1 to 30 days) and then pressed. A second polishing is then performed followed by another natural drying period, and a second pressing. A third cycle of polishing, natural drying and polishing completes the process. The bar is then removed from the mold and packaged.

FIG. 1 illustrates a curvilinear dual-phase soap bar prepared according to the above-described process. The bar is formed with an opaque 1 and a clear 2 portion.

The following example will more fully illustrate the embodiments of this invention. All parts, percentages and proportions referred to herein and in the appended claims are by weight unless otherwise indicated.

EXAMPLE

A toilet bar according to the present invention was prepared having the formula listed below.

FORMULA

| Ingredient | Weight % |
|---|---|
| Glycerin | 25.20 |
| Water | 19.10 |
| Sorbitol | 12.00 |
| Coconut oil | 8.00 |
| Myristic acid | 7.00 |
| Crystal sugar | 7.00 |
| Stearic acid | 6.00 |
| Castor oil | 5.00 |
| Palmitic acid | 4.00 |
| Sodium hydroxide | 4.00 |
| Ethyl alcohol | 1.438 |
| Honey | 0.50 |
| Titanium dioxide | 0.40 |
| Pentavitin | 0.10 |
| Sodium Hyaluronate | 0.10 |
| Sodium PCA | 0.10 |
| EDTA | 0.05 |
| Vitamin E | 0.012 |

The ingredients as shown above were added to a 2-ton blending and heating vessel. Temperature was brought to 70°-80° C. and maintained there for 3 hours of agitation.

Thereafter, the temperature was lowered to 40°-50° C. The resultant transparent soap composition was poured into a plastic mold filling the mold to the 50% mark. Upon solidification of the transparent composition, about 45 minutes, an opaque composition was poured onto the transparent composition to thereby completely fill the mold. The opaque composition was identical in formula to the corresponding transparent composition but additionally contained titanium dioxide.

The molded soap bars were kept for 10 days on open curing racks before press molding.

Thereafter, the crude pressed soap bars were further cured on the racks for 20 more days prior to a final press molding. Then the bars were wrapped and labeled.

The foregoing description and example show selected embodiments of the present invention. In light thereof, various modifications will be suggested to one skilled in the art, all of which are within the spirit and purview of this invention.

What is claimed is:

1. A dual-phase toilet bar comprising:

(i) a first portion that is at least translucent; and (ii) a second portion that is opaque, said second portion achieving opacity through incorporation of from about 0.01 to about 10% of a particulate opacifying agent, the first and second portions having at least 90% by weight of their ingredients being identical and joining one another only along a single curvilinear shaped surface.

2. The bar according to claim 1 wherein at least 99% by weight of the ingredients of the first portion are identical to those of the second portion.

3. The bar according to claim 1 wherein the solid opacifying agent is selected from the group consisting of titanium dioxide, alumina, zinc oxide, calcium carbonate and combinations thereof.

4. A method for preparing a toilet bar formed at least 30% thereof with a clear first portion and at least 30% thereof with an opaque second portion, said portions adjoining one another only along a single curvilinear shaped surface, the method comprising the steps of:

(i) preparing a clear soap composition;

(ii) pouring said clear soap composition into a mold to fill said mold to a level no higher than 90% of its capacity thereby forming said clear first portion;

(iii) pouring a second soap composition into said mold onto said clear first portion at a time when said poured clear first portion has maturated to a level just short of hardening, said second soap composition being opaque having at least 80% by weight of its ingredients identical to that of said clear soap composition, and additionally including from about 0.5 to about 10% by weight of a solid opacifying agent thereby forming said opaque second portion; and (iv) cooling and hardening the clear and opaque portions to obtain said toilet bar.

5. The method according to claim 4 wherein at least 99% by weight of the ingredients of the first portion are identical to those of the second portion.

6. The method according to claim 4 wherein the solid opacifying agent is selected from the group consisting of titanium dioxide, alumina, zinc oxide, calcium carbonate, and combinations thereof.

7. A method for preparing a toilet bar formed at least 30% thereof with a clear first portion and at least 30% thereof with an opaque second portion, said portions adjoining one another only along a single curvilinear shaped surface, the method comprising the steps of:

(i) preparing a clear soap composition;

(ii) preparing an opaque soap composition, said opaque soap composition having at least 80% by weight of its ingredients identical to that of said clear soap composition, and additionally including from about 0.5–10% by weight of a solid particulate opacifying agent;

(iii) pouring said opaque soap composition into a mold to fill the mold to a level no higher than 90% of its capacity thereby forming said opaque second portion;

(iv) pouring said clear soap composition into said mold onto said opaque second portion at a time when said opaque second portion has maturated to a level just short of hardening, said clear soap composition thereby forming said clear first portion; and (v) cooling and hardening the first and second portions to obtain the toilet bar.

8. The method according to claim 7 wherein at least 99% by weight of the ingredients of the first portion are identical to those of the second portion.

9. The method according to claim 7 wherein the solid opacifying agent is selected from the group consisting of titanium dioxide, alumina, zinc oxide, calcium carbonate, and combinations thereof.

* * * * *